US006967310B2

(12) United States Patent
Austin et al.

(10) Patent No.: US 6,967,310 B2
(45) Date of Patent: Nov. 22, 2005

(54) SMOKELESS VENT SYSTEM FOR A COOKING APPLIANCE

(75) Inventors: Kerry O. Austin, Ocoee, TN (US); Perry A. Bennett, Cleveland, TN (US); Norman B. Davis, Cleveland, TN (US); Dean I. Griffey, Cleveland, TN (US); Steven M. Haring, Ooltewah, TN (US); Donnie L. Keith, Cleveland, TN (US); Gary E. Keller, Delano, TN (US); Jeffrey K. McLeod, Riceville, TN (US); Jason Lewallen, Old Fort, TN (US); Norman T. McGuffey, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 33 days.

(21) Appl. No.: 10/819,913

(22) Filed: Apr. 8, 2004

(65) Prior Publication Data

US 2005/0224490 A1 Oct. 13, 2005

(51) Int. Cl.[7] ..... A21B 1/14; A21B 1/22; A21B 3/04

(52) U.S. Cl. ..... 219/408; 219/391; 219/394; 219/400; 126/214

(58) Field of Search ..... 219/400, 391, 219/393, 394, 408; 126/21 A

(56) References Cited

U.S. PATENT DOCUMENTS 3,255,746 A 6/1966 Jenn et al.
3,367,316 A * 2/1968 Eff ..... 126/21 A
3,504,161 A * 3/1970 Kastovich ..... 219/393
4,163,894 A * 8/1979 Scherer ..... 219/391
4,375,213 A * 3/1983 Kemp et al. ..... 126/21 A
4,547,642 A * 10/1985 Smith ..... 219/685
4,555,606 A * 11/1985 Thomas et al. ..... 219/757
4,601,279 A 7/1986 Guerin
4,633,850 A 1/1987 Hawkins et al.
4,763,638 A * 8/1988 Hurley et al. ..... 126/21 A
5,622,100 A * 4/1997 King et al. ..... 99/386
5,738,081 A 4/1998 Puricelli
5,918,589 A * 7/1999 Valle et al. ..... 126/193
6,388,235 B1 * 5/2002 Sauter et al. ..... 219/400

* cited by examiner

*Primary Examiner*—Joseph Pelham
(74) *Attorney, Agent, or Firm*—Diederiks & Whitelaw, PLC; Allan P. Orsund

(57) ABSTRACT

A cooking appliance includes an exhaust system that substantially eliminates potential smoke generating byproducts carried by oven gases. The cooking appliance includes an oven cavity having a top wall including a recessed portion within which is mounted a broil element. A plurality of openings are formed in the recessed portion that allow exhaust gases to pass into a smoke elimination chamber. Heat generated by the broil element and in the smoke elimination chamber removes substantially all combustion byproducts contained in the exhaust gases. To further remove combustion byproducts, the exhaust gases are passed through a ceramic catalyst prior to being directed into a vent duct. From the vent duct, the exhaust gasses are directed past a blower into an exhaust duct that, ultimately, guides the exhaust gases from the appliance.

30 Claims, 7 Drawing Sheets

SMOKELESS VENT SYSTEM FOR A COOKING APPLIANCE

BACKGROUND OF THE INVENTION

1. Field of the Invention

The present invention pertains to the art of cooking appliances and, more particularly, to an oven vent system that eliminates smoke from gases produced in the oven during a cooking operation.

2. Discussion of the Prior Art

Cooking appliances that cook a food item arranged within an oven cavity through various heating techniques, such as radiant, conduction and/or convection techniques, are known. During a cooking operation, the generated heat impinges upon the food item resulting in both the cooking of the food item and the production of oven gases laden with combustion byproducts. The byproducts of combustion typically transform into smoke that is carried by the oven gases through an exhaust system. If the exhaust system is not directed outdoors, the smoke can accumulate in areas of a home where the appliance is located. In addition, the byproducts of combustion can adhere to inner portions of the exhaust system, resulting in a degradation in performance.

In recognition of this problem, manufacturers have developed several techniques to eliminate byproducts of combustion from the oven gases. In some cases, the oven gases are directed past a ceramic catalyst. The ceramic catalyst is heated by the appliance to a temperature such that the combustion byproducts are exposed to an additional combustion process. The additional combustion process lowers the level of byproducts carried in the oven gases. In this manner, the resulting smoke produced by the combustion byproducts is reduced. In other cases, the oven gases are directed through ducts that are arranged in close proximity to the oven cavity. The close proximity to the oven cavity raises an internal temperature of the ducts. In a manner similar to that described above, the combustion byproducts that pass through the heated ducts are exposed to an additional combustion process which results in a reduction in smoke output by the appliance.

Regardless of the method employed, there still exists an amount of combustion byproducts in the oven gases that can produce smoke. Smoke laden oven gases that enter into habitable spaces of a home can become an irritant. Additionally, smoke can also discolor areas that are adjacent to the cooking appliance. Therefore, there still exists a need for a vent system for a cooking appliance that can more effectively reduce combustion byproducts from oven gases. More specifically, there exists a need for an exhaust system that will reduce combustion byproducts to a level that will almost completely eliminate any smoke that may exit the cooking appliance into habitable areas of a home.

SUMMARY OF THE INVENTION

The present invention is directed to a cooking appliance having an exhaust system designed to eliminate smoke from oven gases produced during a cooking operation. The appliance includes an oven cavity having top, bottom, rear and opposing side walls. In accordance with the invention, a recessed portion is formed in the top wall of the oven cavity. Arranged within the recessed portion is a broil element that, upon selection of a cooking operation, operates to establish a heated atmosphere in the oven cavity. The exhaust system also includes a plurality of exhaust openings formed in the recessed portion of the top wall. The plurality of exhaust openings allow oven gases to pass across the broil element and into a smoke elimination chamber. The smoke elimination chamber is defined by an area between a baffle plate and the top wall of the oven cavity. By passing the oven gases across the broil element, combustion byproducts, carried by the oven gases, are exposed to a first combustion or removal step prior to entering the smoke elimination chamber.

In further accordance with the invention, as the smoke elimination chamber is positioned atop the oven cavity, heat produced in the oven cavity raises an internal temperature of the smoke elimination chamber. Thus, as the oven gases pass through the smoke elimination chamber, the internal temperature acts to further reduce combustion byproducts carried by the oven gases. Therefore, remaining combustion byproducts are subjected to a second removal step. The oven gases then exit the smoke combustion chamber into a vent duct. In accordance with the invention, the oven gases are passed through a ceramic catalyst prior to or along the vent duct. The ceramic catalyst removes most, if not all, of the combustion byproducts that remain in the oven gases. At this point, the oven gases are directed through the vent duct and out of a vent cover toward an exhaust blower. The blower guides the oven gases into an exhaust duct that extends along a rear portion of the cooking appliance. Ultimately, the oven gases, which are essentially free of smoke and other byproducts, are directed away from the appliance.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
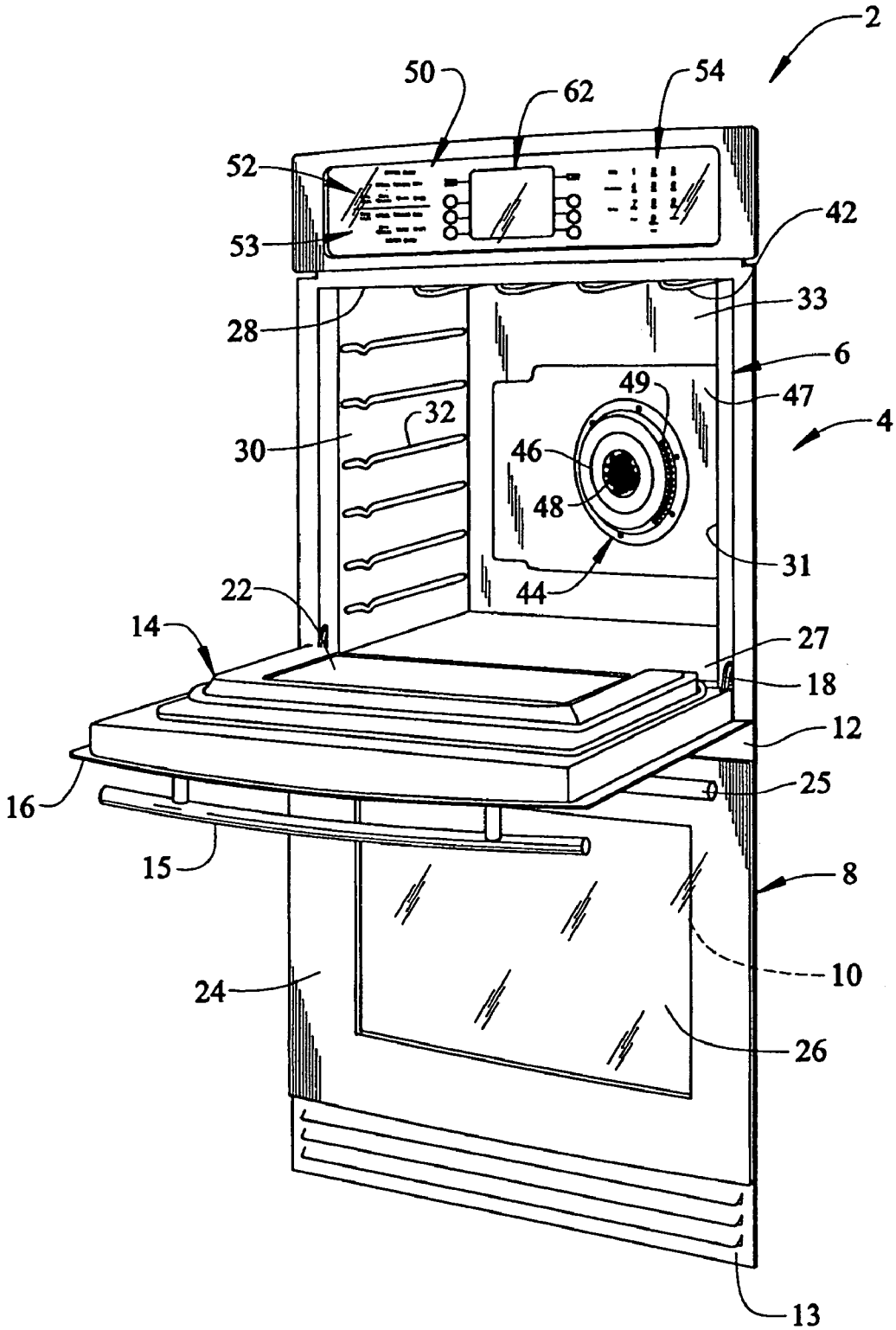
FIG. 1 is a perspective view of a wall oven incorporating a smokeless vent system constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention is not limited to this model type and can be incorporated into various other types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 also includes an outer frame 12 for supporting both upper and lower oven cavities 6 and 10 and an exhaust vent 13.

In a manner known in the art, a door assembly 14 is included to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24 including a handle 25 and a transparent zone or window 26 is provided for lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. In the embodiment shown, bottom wall 27 conceals a bake element 40 (see FIG. 2). Bottom wall 27 therefore constitutes a smooth, flat surface that is designed to improve the overall cleanability of oven cavity 6. Also, as will be discussed more fully below, a top broil element 42 is arranged along upper wall 28 of oven cavity 6. Top broil element 42 is particularly provided to enable a consumer to perform a grilling process in upper oven 4 and to aid in pyrolytic heating during a self-clean operation. More specifically, both bake element 40 and top broil element 42 are constituted by sheathed, electric resistive heating elements.

Based on the above, cooking appliance 2 actually constitutes an electric, dual wall oven. In addition, both oven cavities 6 and 10 preferably employ both radiant and convection heating techniques for cooking food items therein. To this end, rear wall 33 is shown to include a convection fan or blower 44 having a cover 46. Cover 46 is actually mounted to a rear panel 47 that defines a housing (not separately labeled) for fan 44. Although the exact position and construction of fan 44 can readily vary in accordance with the invention, in the embodiment shown, fan 44 draws in air at a central intake zone 48 and directs the air into oven cavity 6 in a radial outward direction through a plurality of outlet vents 49. Actually, fan 44 preferably includes a separate heating element (not shown) for heating the air flow directed through cover 46.

As further shown in FIG. 1, cooking appliance 2 includes an upper control panel 50 having a plurality of control elements. In accordance with the embodiment shown, the control elements are constituted by first and second sets of oven control buttons 52 and 53, as well as a numeric pad 54. Control panel 50 is adapted to be used to input desired cooking parameters and input initial operating conditions for cooking appliance 2. More specifically, the first and second sets of control buttons 52 and 53, in combination with numeric pad 54 and a display 62, enable a user to establish particular cooking operations for upper and lower ovens 4 and 8 respectively. In general, the structure described above is known in the art and is actually presented in commonly assigned U.S. patent application Ser. No. 10/410,155, filed on Apr. 10, 2003, entitled "Menu Driven Control System for a Cooking Appliance" incorporated herein by reference. As the structure and basic operation of cooking appliance 2 is known in the art and does not form part of the present invention, no further details thereof will be provided here. Instead, the present invention is particularly directed to an exhaust air flow or venting arrangement for cooking appliance 2 that eliminates or, at least substantially reduces, combustion byproducts from oven gases that are produced in either upper oven 4 or lower oven 8 during respective cooking operations.

Figure 2:
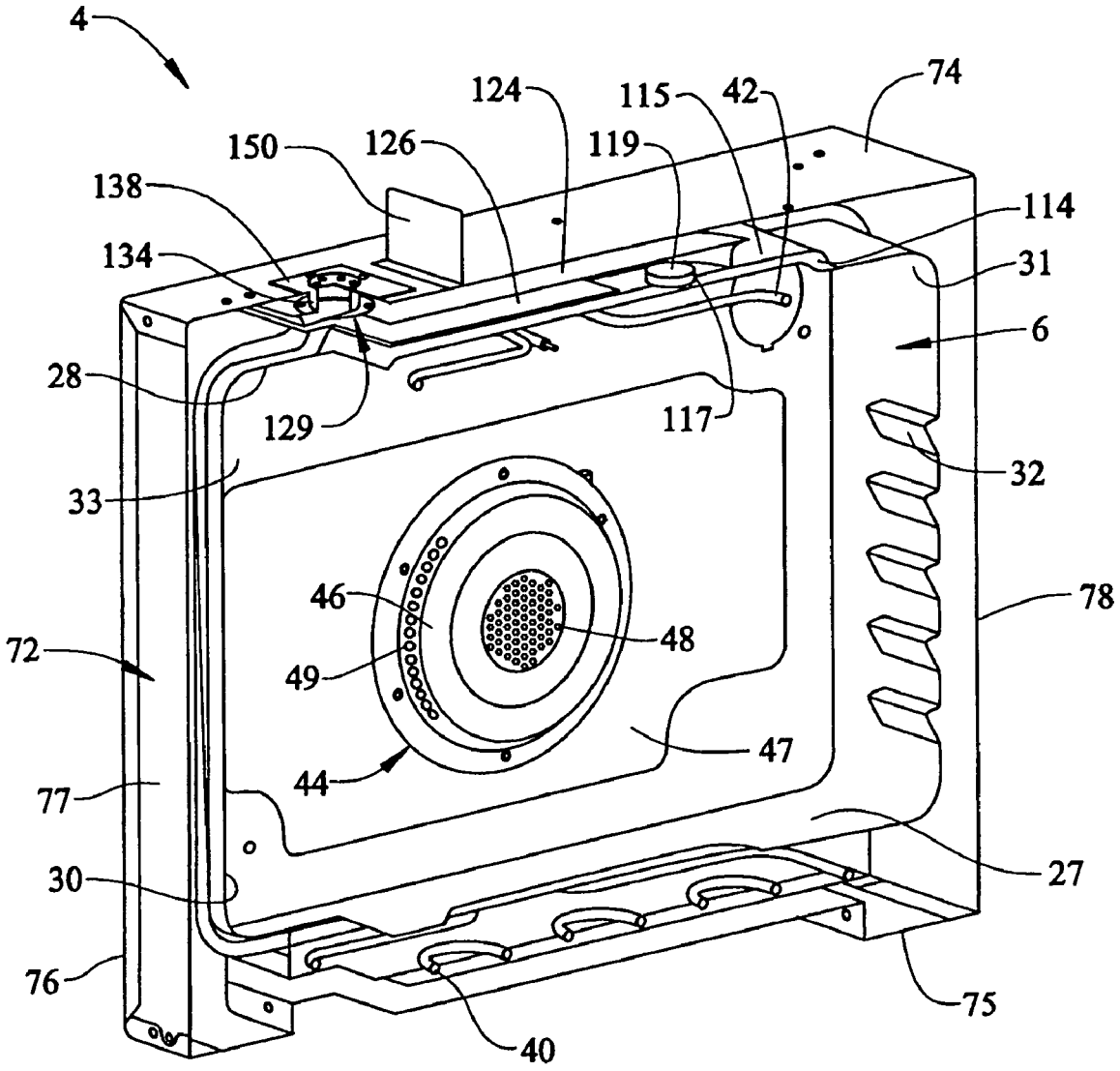
FIG. 2 is a partial, cross-sectional view illustrating an upper oven cavity of the cooking appliance of FIG. 1.
Figure 3:
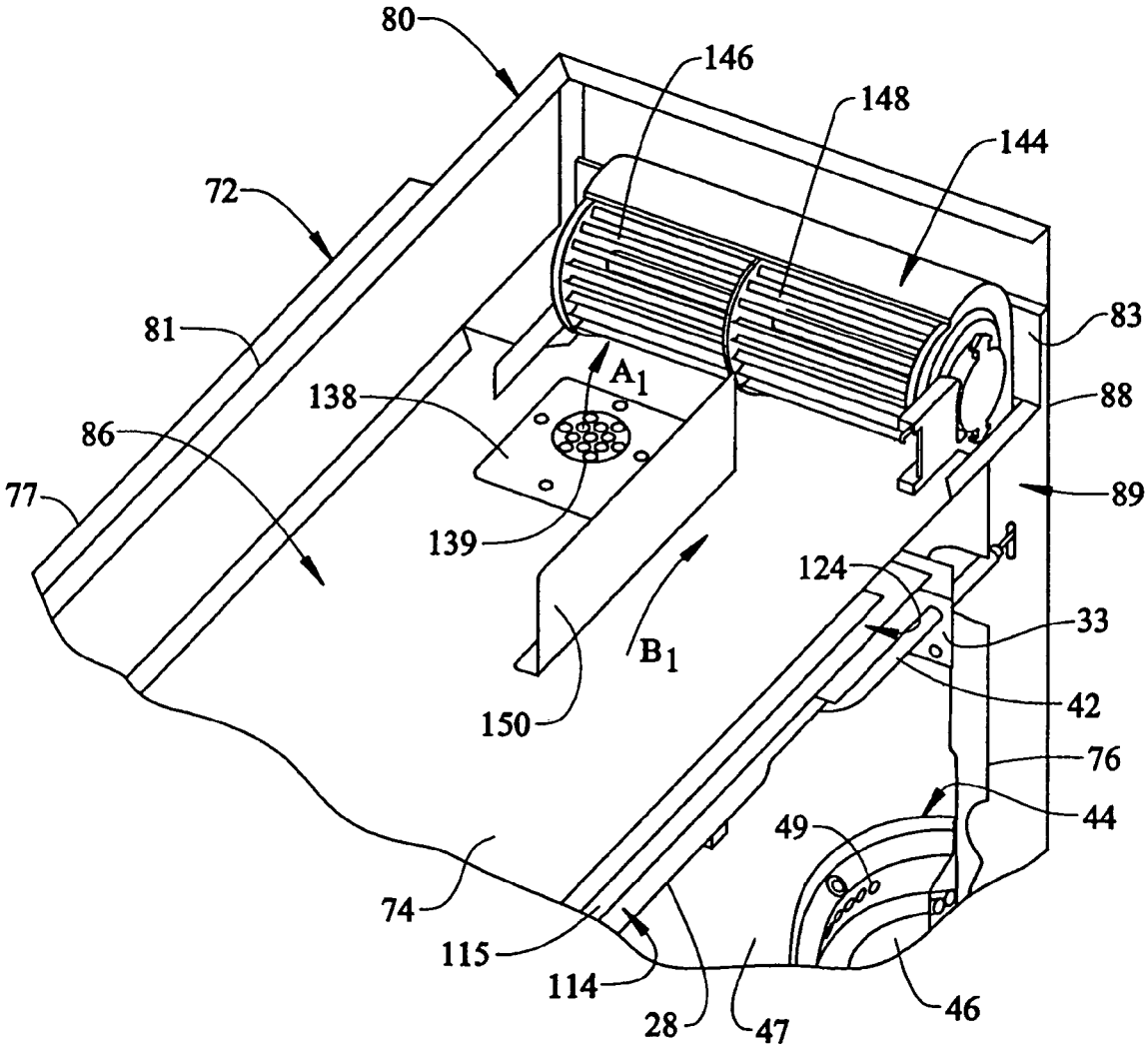
FIG. 3 is an enlarged, cross-sectional view of a top portion of the upper oven cavity of FIG. 2.
Figure 4:
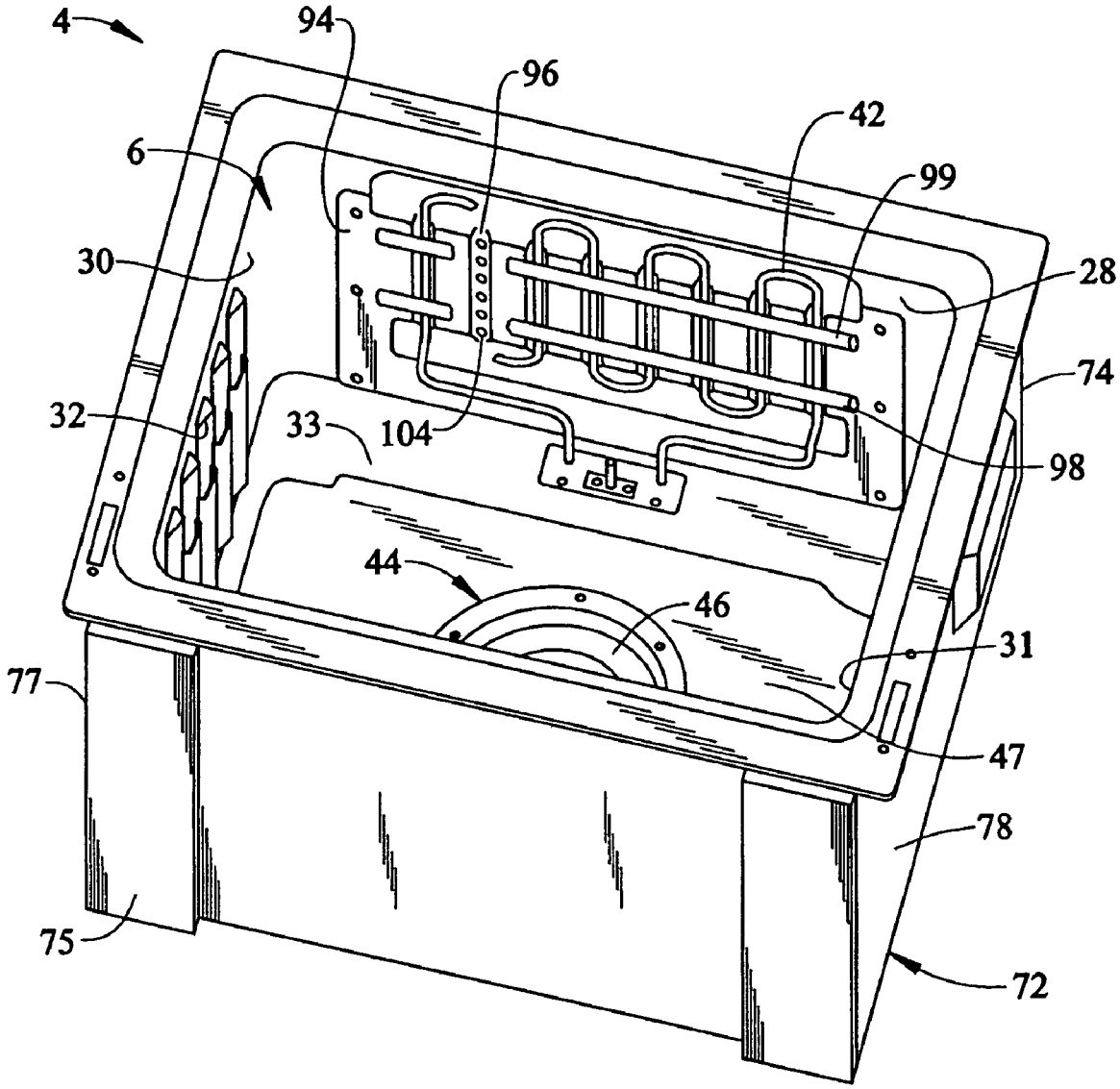
FIG. 4 is a lower, partial perspective view of the oven cavity of FIG. 2, illustrating a broil element mounted in accordance with the present invention.

Reference will now be made to FIGS. 2–4 in describing a preferred embodiment of the present invention. As shown, upper oven 4 includes an outer cabinet or shell 72 having top, bottom, rear and opposing side walls 74–78. In accordance with the invention, arranged on top wall 74 is an air box 80 (FIG. 3). As perhaps best shown in FIG. 7, air box 80 includes first and second side walls 81 and 82, a rear wall 83 and a top wall 84 that collectively define an air plenum 86. Plenum 86 extends from a control compartment or housing 87 provided behind control panel 50 toward a rear portion of cooking appliance 2. Arranged within control compartment 87 are the various electronics (not shown) for operating cooking appliance 2. As best shown in FIG. 3, extending along a rear portion of cooking appliance 2 at a position spaced from rear wall 76, is a back panel or cover 88. Cover 88, together with rear wall 76, define a rear duct 89 that, as will be detailed more fully below, provides a passage for both exhaust gases and cooling air for cooking appliance 2.

As best shown in FIG. 4, arranged on upper wall 28 of oven cavity 6 is a plate 94. As shown, plate 94 includes a plurality of fore-to-aft extending troughs or recesses 96. In accordance with the invention, broil element 42 is secured to plate 94 such that leg portions (not separately labeled) of broil element 42 are received by, and actually nest within, troughs 96. As further shown in FIG. 4, broil element 42 is secured to plate 94 by a plurality of support members 98 and 99. In the most preferred form of the invention, troughs 96 include a plurality of exhaust openings, indicated generally at 104, that guide oven gases from oven cavity 6. With this arrangement, as will be discussed more fully below, the oven gases pass across broil element 42 such that byproducts of combustion carried by the oven gases are partially burned before exiting oven cavity 6 through exhaust openings 104.

In further accordance with the preferred form of the invention, the oven gases passing through exhaust openings 104 from oven cavity 6 are directed into a smoke elimination chamber 114 (see FIGS. 2 and 3). As best shown in FIG. 2, smoke elimination chamber 114 is defined by an area between a baffle plate 115 and top wall 28 of oven cavity 6. With this arrangement, heat from oven cavity 6 passes, via conduction, into smoke elimination chamber 114, thereby raising the temperature within smoke elimination chamber 114. With the elevated temperature, smoke elimination chamber 114 serves to burn away another portion of the combustion byproducts. At this point, the oven gases in smoke elimination chamber 114 pass through an outlet portion 117 within which is arranged a catalyst 119, preferably formed of ceramic, that serves to still further burn the combustion byproducts carried by the oven gases. Ceramic catalyst 119 leads to a vent duct 124 having a plenum 126 that extends across smoke elimination chamber 114 to an outlet 129. In accordance with the invention, outlet 129 is provided with a vent tube 134 that guides oven gases upward through a vent cover 138, provided with a plurality of openings 139, into plenum 86.

As best seen in FIG. 3, the gases passing into plenum 86 from upper oven cavity 6 are directed toward a tangential blower 144 arranged on top wall 74 of outer cabinet 72. In the embodiment shown, tangential blower 144 is actually bifurcated, having a first or exhaust portion 146 and a second or cooling air portion 148, each of which is adapted to receive a separate air flow. Toward that end, arranged on top wall 74 is a diverter plate 150 that guides an exhaust air flow, i.e., oven gases A1, toward exhaust portion 146 of tangential blower 144. On an opposite side of diverter plate 150 is a cooling air flow B1 that is actually drawn in through control compartment 87 to provide a cooling air flow for the electronics contained therein. Cooling air flow B1 then passes into cooling air portion 148 of tangential blower 144 and is thereafter re-directed into rear duct 89.

Figure 5:
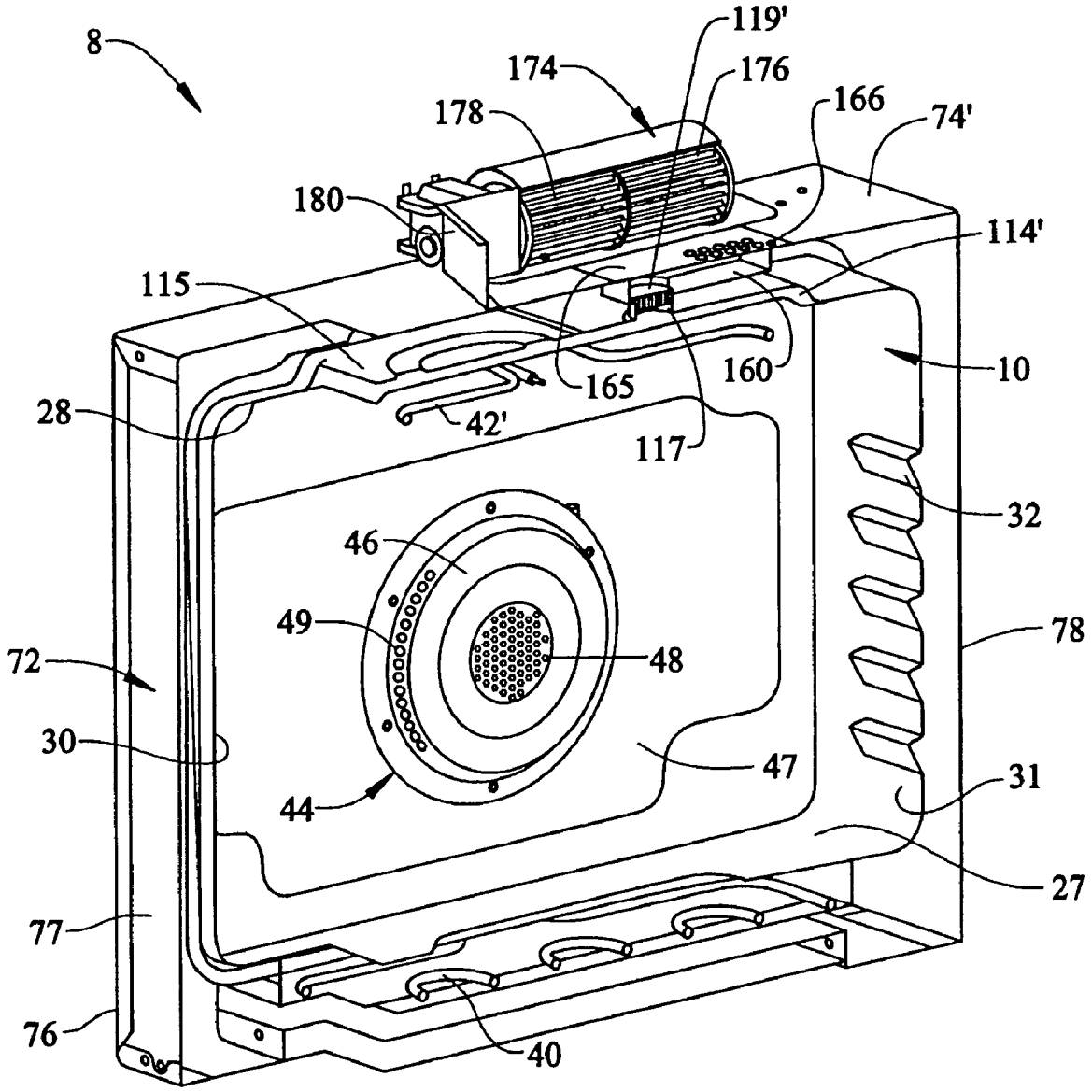
FIG. 5 is a partial cross-sectional view illustrating a lower oven cavity of the cooking appliance depicted in FIG. 1.
Figure 6:
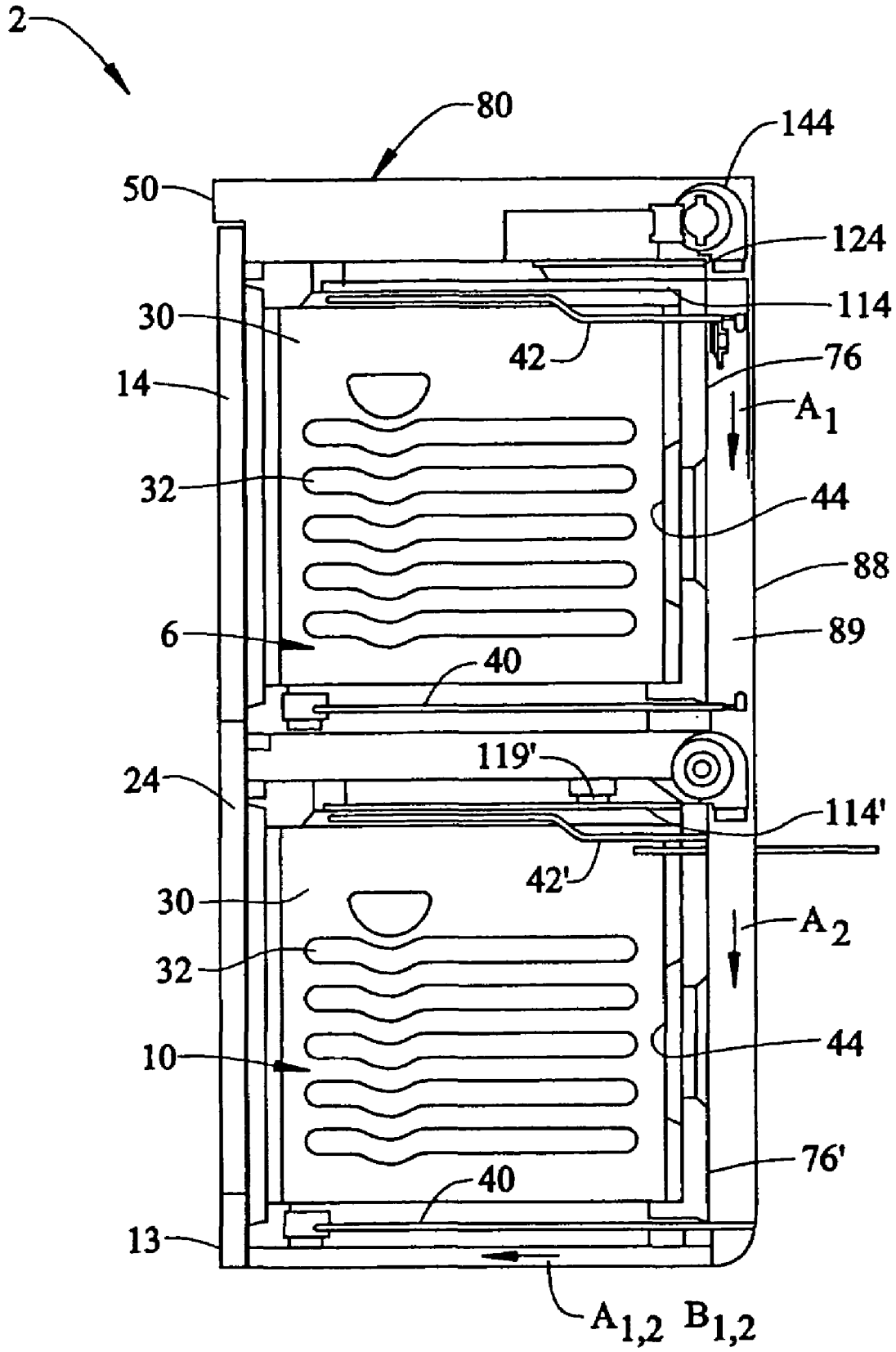
FIG. 6 is a partial, cross-sectional side view of the cooking appliance of FIG. 1 illustrating exhaust flow paths in accordance with the present invention.

Reference will now be made to FIG. 5, wherein like reference numerals represent corresponding components in describing a preferred embodiment of the smoke elimination system for lower oven 8. In order to separate oven gases produced in oven cavity 6 from oven gases produced in oven cavity 10, as well as to provide some measure of uniformity between upper and lower ovens 4 and 8, most of the overall structure of the respective smoke elimination systems is identical. However, lower oven 8 is provided with a vent box 160 that is recessed within upper wall 74' of cabinet 72. In a manner similar to that described above, oven gases pass across a broil element 42' through exhaust openings (not shown) into a smoke elimination chamber 114'. Thereafter, the oven gases exit smoke elimination chamber 114', flow through ceramic catalyst 119', and are guided directly into vent box 160. As shown, vent box 160 extends axially across a top of oven cavity 10 in a direction opposite to that employed in oven cavity 6. Vent box 160 is provided with a vent cover 165 having a plurality of apertures 166 that are arranged adjacent to a lower tangential blower 174. In a manner corresponding to that described above with respect to tangential blower 144, lower tangential blower 174 is bifurcated to define an exhaust air portion 176 and a cooling air portion 178. In addition, arranged on upper wall 74' is a guide wall 180 that, at least in part, establishes an air plenum above lower oven 8, and a diverter plate (not shown) that, in a manner corresponding to diverter plate 150, separates cooling air from exhausting oven gases.

Figure 7:
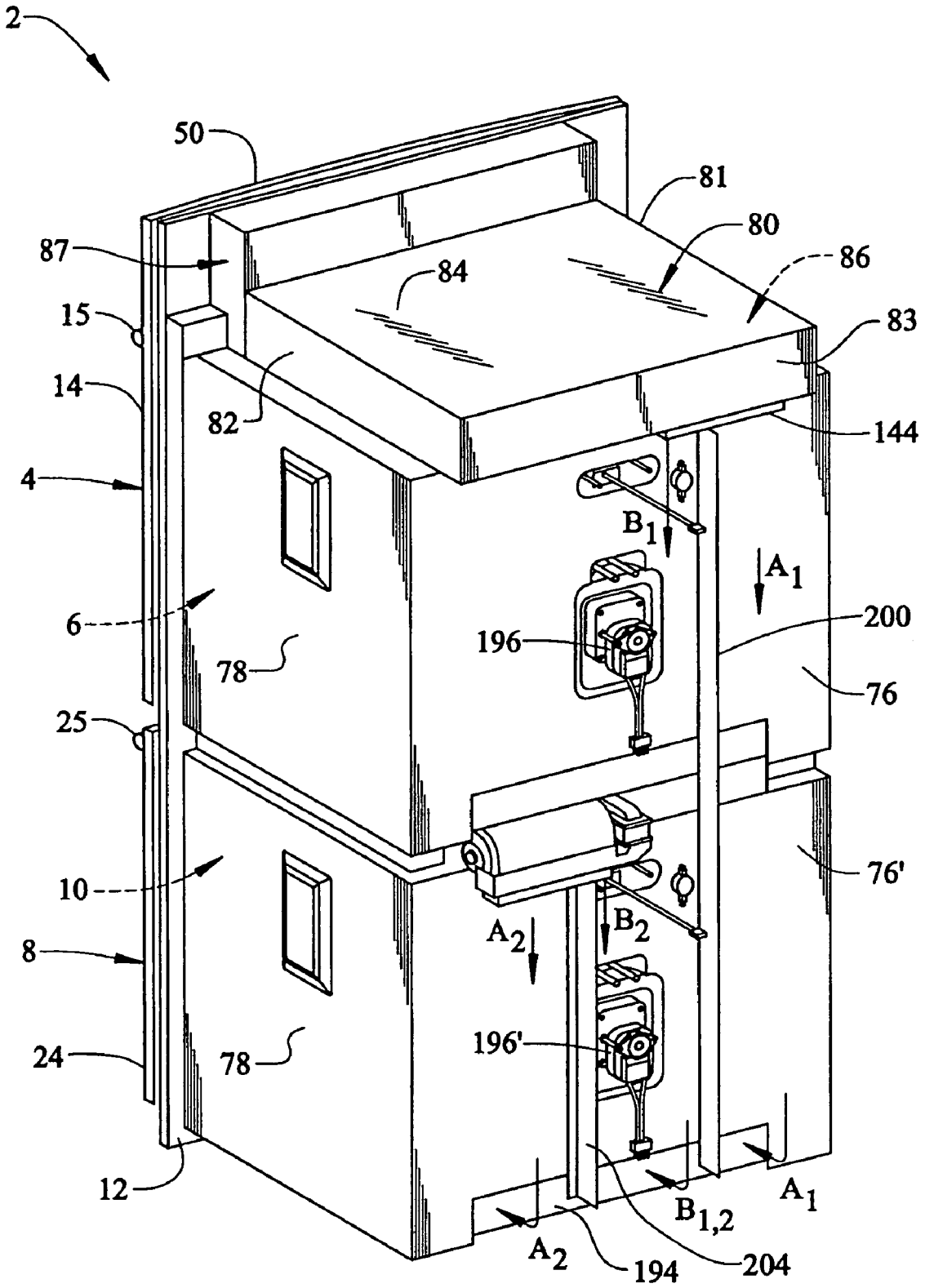
FIG. 7 is a rear perspective view of the cooking appliance of FIG. 1 illustrating exhaust system duct work in accordance with the present invention.

At this point, reference will be made to FIGS. 4–7 in describing an overall air flow for cooking appliance 2. In accordance with the most preferred form of the invention, oven gases generated within upper oven cavity 6 pass across broil element 42 through exhaust openings 104 into smoke elimination chamber 114. As described above, by forcing the oven gases to pass across broil element 42, a major portion of the combustion byproducts carried by the oven gases is burned away. Once in smoke elimination chamber 114, heat produced by oven cavity 6 further serves to combust the air laden byproducts. However, in order to ensure that virtually all combustion byproducts are eliminated from the oven gases, the oven gases are passed through ceramic catalyst 119 prior to entering into vent duct 124. As described above, the oven gases then pass through vent cover 138 into tangential blower 144. As shown in FIG. 7, tangential blower 144 guides oven gases A1 from upper oven cavity 6 down along rear wall 76 toward a lower exhaust passage 194. In addition, cooling air B1 is passed along rear wall 76 adjacent to a convection fan motor 196 to provide cooling. To that end, a separator plate 200 is provided on rear wall 76 so as to define a bifurcated exhaust passage. Separator plate 200 actually divides oven gases A1 from cooling air B1 prior to lower exhaust passage 194. Thus, in the embodiment shown, separator plate 200 extends from blower 144 to exhaust passage 194.

In a manner similar to that described above with respect to upper oven cavity 6, oven gases produced within lower oven cavity 10 pass across broil element 42' so that a first portion of byproducts of combustion may be eliminated. The oven gases then pass through exhaust openings 104 (not shown) into smoke elimination chamber 114'. In order to further eliminate combustion byproducts, the oven gases are passed through ceramic catalyst 119' and then into vent box 160. As described above, the oven gases enter into lower tangential blower 174 which guide exhaust gases A2 toward lower exhaust passage 194. Likewise, a cooling air flow B2 passes from tangential blower 174 along a rear wall 76' to cool fan components such as a convection fan motor 196'. In a manner corresponding to that described above, rear wall 76' is provided with a separator plate 204 that divides cooling air flow B2 and oven gases A2. Actually, separator plate 204 defines, in combination with separator plate 200, a trifurcated exhaust passage along rear wall 76', with oven gases A1 and A2 being maintained in outer lateral portions, while cooling air flows B1 and B2 are confined to a central portion as clearly shown in FIG. 7. Once in lower exhaust passage 194, both the oven gases A1, A2 and cooling air flows B1, B2 from upper and lower oven cavities 6, 8 respectively, pass below lower oven 8 and out through vent 13. With this arrangement, the oven gases are subjected to multiple stages of byproduct elimination such that the oven gases passing from vent 13 are substantially, if not completely, free of byproducts of combustion that may otherwise produce smoke or noxious fumes within the environment surrounding cooking appliance 2.

Although described with reference to a preferred embodiment of the present invention, it should be readily apparent to one of ordinary skill in the art that various changes and/or modifications can be made to the invention without departing from the spirit thereof. In general, the invention is only intended to be limited by the scope of the following claims.

We claim:

1. A cooking appliance including a venting system for eliminating byproducts from exhaust gases comprising:

an oven cavity including top, bottom, rear and opposing side walls, along with a frontal opening, said top wall including a recessed portion;

a door pivotally mounted relative to the oven cavity across the frontal opening, said door selectively providing access to the oven cavity;

a broil element mounted so as to establish a heated atmosphere in the oven cavity, said broil element being positioned, at least in part, within the recessed portion;

a control panel including a plurality of control elements for selectively operating the broil element to perform a cooking operation in the oven cavity; and a venting system for directing exhaust gases from the oven cavity away from the cooking appliance, said exhaust system including:

a plurality of exhaust openings formed in the recessed portion of the top wall, said plurality of exhaust openings directing exhaust gases, exiting the oven cavity, past the broil element, wherein byproducts present in the exhaust gases generated during operation of the cooking appliance are at least partially reduced;

a baffle plate arranged above the top wall of the oven cavity, said baffle plate defining, at least in part, a smoke elimination chamber that is in fluid communication with the oven cavity through the plurality of exhaust openings, said smoke elimination chamber being heated during operation of the cooking appliance such that the exhaust gases directed into the smoke elimination chamber are heated to further reduce the byproducts;

a vent duct arranged above the baffle plate, said vent duct being in fluid communication with the smoke elimination chamber and arranged to guide the exhaust gases across a portion of the top wall of the oven cavity;

a vent cover leading the exhaust gases from the vent duct;

a catalyst fluidly arranged between the plurality of exhaust openings and the vent cover to expose the exhaust gases to further byproduct reduction;

an exhaust duct extending adjacent the rear wall of the oven cavity; and a blower for directing the exhaust gases exiting from the vent cover into the exhaust duct.

2. A cooking appliance including a venting system for eliminating byproducts from exhaust gases comprising:

an oven cavity including top, bottom, rear and opposing side walls, along with a frontal opening, said top wall including a recessed portion;

a door pivotally mounted relative to the oven cavity across the frontal opening, said door selectively providing access to the oven cavity;

a broil element mounted so as to establish a heated atmosphere in the oven cavity, said broil element being positioned, at least in part, within the recessed portion;

a control panel including a plurality of control elements for selectively operating the broil element to perform a cooking operation in the oven cavity; and a venting system for directing exhaust gases from the oven cavity away from the cooking appliance, said exhaust system including a plurality of exhaust openings formed in the recessed portion of the top wall, said plurality of exhaust openings directing exhaust gases, exiting the oven cavity, past the broil element, wherein byproducts present in the exhaust gases generated during operation of the cooking appliance are at least partially reduced.

3. The cooking appliance according to claim 2, wherein the venting system further includes a baffle plate arranged above the oven cavity, said baffle plate defining, at least in part, a smoke elimination chamber that is in fluid communication with the oven cavity through the plurality of exhaust openings, said smoke elimination chamber being heated during operation of the cooking appliance such that the exhaust gases directed into the smoke elimination chamber are heated to further reduce the byproducts.

4. The cooking appliance according to claim 3, wherein the venting system further includes a catalyst fluidly arranged between the plurality of exhaust openings and the vent cover to expose the exhaust gases to further byproduct reduction.

5. The cooking appliance according to claim 4, wherein the catalyst is made of ceramic.

6. The cooking appliance according to claim 4, wherein the venting system includes a vent cover that directs exhaust gases coming from the smoke elimination chamber out of the cooking appliance.

7. The cooking appliance according to claim 6, wherein the venting system further includes an exhaust duct extending adjacent the rear wall of the oven cavity.

8. The cooking appliance according to claim 7, wherein the exhaust duct leads to and expels exhaust gases through a lower front portion of the cooking appliance.

9. The cooking appliance according to claim 8, wherein the venting system includes a blower that draws exhaust gases from the vent cover and thereafter guides the exhaust gases into the exhaust duct.

10. The cooking appliance according to claim 9, further comprising: a diverter plate positioned adjacent an intake of the blower, said diverter plate separating the exhaust gases from a flow of cooling air.

11. The cooking appliance according to claim 8, wherein the cooking appliance is constituted by a dual wall oven having an upper oven cavity and a lower oven cavity.

12. The cooking appliance according to claim 11, wherein the exhaust duct extends behind each of the upper and lower oven cavities and thereafter leads to the lower front portion the cooking appliance.

13. The cooking appliance according to claim 12, wherein the venting system includes another exhaust duct that extends behind the lower oven cavity and thereafter leads to the lower front portion of the cooking appliance, said exhaust duct receiving exhaust gases from the upper oven cavity and said another exhaust duct receiving exhaust gases from the lower oven cavity.

14. The cooking appliance according to claim 13, further comprising: a pair of separator plates which space the exhaust duct from the another exhaust duct behind at least the lower oven cavity.

15. The cooking appliance according to claim 14, wherein the pair of separator plates space the exhaust duct from the another exhaust duct by a cooling air region.

16. A cooking appliance including a venting system for eliminating byproducts from exhaust gases comprising:

an oven cavity including top, bottom, rear and opposing side walls, along with a frontal opening;

a door pivotally mounted relative to the oven cavity across the frontal opening, said door selectively providing access to the oven cavity;

a broil element mounted so as to establish a heated atmosphere in the oven cavity;

a control panel including a plurality of control elements for selectively operating the broil element to perform a cooking operation in the oven cavity; and a venting system for directing exhaust gases from the oven cavity away from the cooking appliance, said exhaust system including:

a baffle plate arranged above the top wall of the oven cavity, said baffle plate defining, at least in part, a smoke elimination chamber that is in fluid communication with the oven cavity, said smoke elimination chamber being heated during operation of the cooking appliance such that the exhaust gases directed into the smoke elimination chamber are heated to further reduce the byproducts;

a vent duct arranged above the baffle plate, said vent duct being in fluid communication with the smoke elimination chamber and arranged to guide the exhaust gases across a portion of the top wall of the oven cavity;

an exhaust duct extending adjacent the rear wall of the oven cavity; and a blower for directing the exhaust gases exiting from the vent cover into the exhaust duct.

17. The cooking appliance according to claim 16, wherein the top wall of the oven cavity includes a recessed portion, said broil element being nested, at least in part, within the recessed portion.

18. The cooking appliance according to claim 17, wherein the venting system further includes a plurality of exhaust openings formed in the recessed portion of the top wall, said plurality of exhaust openings directing exhaust gases, exiting the oven cavity, past the broil element, wherein byproducts present in the exhaust gases generated during operation of the cooking appliance are at least partially reduced.

19. The cooking appliance according to claim 18, wherein the smoke elimination chamber includes an inlet portion constituted by the plurality of exhaust openings and an outlet portion that opens into the vent duct.

20. The cooking appliance according to claim 19, wherein the venting system further includes a catalyst fluidly arranged between the plurality of exhaust openings and the vent cover to expose the exhaust gases to further byproduct reduction.

21. The cooking appliance according to claim 16, further comprising:

a diverter plate positioned adjacent an intake of the blower, said diverter plate separating the exhaust gases from a flow of cooling air.

22. The cooking appliance according to claim 16, wherein the cooking appliance is constituted by a dual wall oven having an upper oven cavity and a lower oven cavity.

23. The cooking appliance according to claim 22, wherein the venting system includes another exhaust duct that extends behind the lower oven cavity and thereafter leads to the lower front portion of the cooking appliance, said exhaust duct receiving exhaust gases from the upper oven cavity and said another exhaust duct receiving exhaust gases from the lower oven cavity.

24. The cooking appliance according to claim 23, further comprising: a pair of separator plates which space the exhaust duct from the another exhaust duct behind at least the lower oven cavity.

25. The cooking appliance according to claim 24, wherein the pair of separator plates space the exhaust duct from the another exhaust duct by a cooling air region.

26. A method of eliminating byproducts from exhaust gases produced in an oven cavity during operation of a cooking appliance comprising:

guiding the exhaust gases past a broil element nested within a recessed portion formed in a top wall of the oven cavity such that the broil element burns at least a portion of byproducts carried by the exhaust gases to reduce an amount of smoke present in the exhaust gases;

directing the exhaust gases through a plurality of exhaust openings provided in the recessed portion into a smoke elimination chamber;

further combusting the byproducts in the smoke elimination chamber so as to further reduce an amount of smoke present in the exhaust gases; and directing the exhaust gases to a vent opening leading away from the cooking appliance.

27. The method of claim 26, further comprising: guiding the exhaust gases through a ceramic catalyst fluidly arranged downstream of the plurality of exhaust openings, said ceramic catalyst further combusting byproducts within the exhaust gases.

28. The method of claim 26, further comprising:

employing a blower to direct the exhaust gases to the vent opening; and diverting the exhaust gases away from a cooling air flow drawn in by the blower.

29. The method of claim 28, further comprising:

employing the method for upper and lower ovens of a dual wall oven; and separating exhaust gases from the upper and lower ovens in at least one exhaust duct extending behind the upper and lower ovens.

30. The method of claim 29, further comprising: directing the cooling air flow between the exhaust gases for the upper and lower ovens.

* * * * *